US007806752B2

(12) United States Patent
Jespersen

(10) Patent No.: US 7,806,752 B2
(45) Date of Patent: Oct. 5, 2010

(54) PROFILE STRIP WITH GRINDING ELEMENT

(75) Inventor: Poul Erik Jespersen, Roslev (DK)

(73) Assignee: Flex Trim A/S, Glyngøre (DK)

( * ) Notice: Subject to any disclaimer, the term of this patent is extended or adjusted under 35 U.S.C. 154(b) by 76 days.

(21) Appl. No.: 11/988,973

(22) PCT Filed: Jul. 20, 2006

(86) PCT No.: PCT/DK2006/000423

§ 371 (c)(1),
(2), (4) Date: Apr. 17, 2008

(87) PCT Pub. No.: WO2007/009466

PCT Pub. Date: Jan. 25, 2007

(65) Prior Publication Data

US 2009/0053984 A1 Feb. 26, 2009

(30) Foreign Application Priority Data

Jul. 21, 2005 (DK) ..... 2005 00168

(51) Int. Cl.
*B24B 29/00* (2006.01)

(52) U.S. Cl. ..... 451/496; 451/469

(58) Field of Classification Search ..... 451/463, 451/464, 465, 466, 467, 468, 469, 484, 499
See application file for complete search history.

(56) References Cited

U.S. PATENT DOCUMENTS

| | | | | |
|---|---|---|---|---|
| 2,804,730 | A * | 9/1957 | Block | 451/469 |
| 4,302,863 | A | 12/1981 | Droeser | |
| 7,169,027 | B2 * | 1/2007 | Jespersen | 451/466 |
| 7,485,030 | B2 * | 2/2009 | Jespersen | 451/496 |

FOREIGN PATENT DOCUMENTS

| | | |
|---|---|---|
| DE | 29608280 | 8/1996 |
| DE | 20018604 | 1/2002 |
| DK | 171364 | 9/1996 |
| EP | 1025958 | 8/2000 |
| EP | 1201153 | 5/2002 |
| WO | WO 01/76824 | 10/2001 |
| WO | WO 2004/103642 | 12/2004 |
| WO | WO 2004/103643 | 12/2004 |

* cited by examiner

*Primary Examiner*—Robert Rose
(74) *Attorney, Agent, or Firm*—James Creighton Wray; Meera P. Narasimhan

(57) ABSTRACT

The present invention relates to a profile strip (1), preferably for a cylinder drum (5) comprising a bottom strip (3) which is designed for replaceable retention of a bottom profile (2) comprising a number of brushes (6) and a number of grinding elements (8) and where the grinding element (8) along the length of a side edge (10) is provided with an edge zone (13) without grinding effect.

17 Claims, 2 Drawing Sheets

PROFILE STRIP WITH GRINDING ELEMENT

This application claims the benefit of Danish Application No. BA 2005 00168 filed Jul. 21, 2005 and PCT/DK2006/000423 filed Jul. 20, 2006, which are hereby incorporated by reference in their entirety.

SCOPE OF THE INVENTION

The present invention relates to a profile strip, preferably a cylinder drum and comprising a bottom strip which is designed for replaceable retention of a bottom profile comprising a number of brushes and a number of grinding elements.

BACKGROUND OF THE INVENTION

Cylinder drums for grinding/polishing surfaces are typically provided in a metal material such as aluminium and are provided with undercut recesses wherein profile strips are arranged.

These profile strips are provided with brushes and grinding elements which as an example may be moulded into a bottom part of the profile strip or where the grinding elements are fastened or glued to the brushes which are moulded into a bottom part of the profile strip.

This entails that it is necessary to replace the entire profile strip if it is desired to apply different types of grinding elements.

Manufacturers who manufacture cylinder drums for grinding and/or polishing machines have gradually safeguarded against that random profile brushes can be applied with their cylinder drum in that the undercut recess has a particular cross-sectional profile.

The buyer is therefore forced to buy the profile strip from the same manufacturer who manufactures the cylinder drum which may increase the operating costs as the manufacturer is able to and will profit from the resulting sale of profile strips.

Today profile strips exist which are provided with bottom strips of aluminium, which, however, is not an advantage in that such a profile strip is not flexible and therefore only can be applied in cylinder drums with lineary undercut recesses.

When applying a profile strip with a bottom strip of aluminium in a cylinder drum of aluminium, wear-damages might occur on the undercut recess of the cylinder drum during operation and in connection with replacement of the profile strip.

OBJECT OF THE INVENTION

The object of the present invention is to indicate a profile strip:

- which is low-cost to manufacture,
- which can be placed in existing cylinder drums regardless of manufacture and the cross-sectional form of the undercut recess of the cylinder drum,
- which does not wear the undercut recess of the cylinder drum during operation or in connection with replacement the profile strip,
- which may be applied with different types of grinding elements, and
- which retains the grinding element to the profile strip.

This is achieved by a profile strip as described in the preamble of claim 1 and where the grinding element along a side edge is designed with an edge zone without a grinding effect and that the edge zone of the grinding element is designed for placing in the profile strip between the bottom profile and the bottom strip.

DESCRIPTION OF THE INVENTION

Preferably, the profile strip is applied in a cylinder drum for a grinding and/or polishing apparatus, but can also be applied for a grinding wheel with radially arranged undercut recesses.

The profile strip comprises a bottom profile and a bottom strip designed for replaceable retention of the bottom profile comprising a number of brushes and a number of grinding elements. In principle, the bottom profile may be mounted directly in a recess on the cylinder drum, but the grinding elements will then wear the recess in the cylinder dram during operation and in connection with replacement of the bottom profile.

The bottom strip is low cost to manufacture and easy to replace and is therefore advantageous to apply. The application of the bottom strip is thus advantageous in that wear will occur on the bottom strip when or if the grinding elements during operation of the cylinder drum or in connection with replacement of the bottom profile carries out a wearing action. When this wearing action has worn the bottom strip in a manner such that an unacceptable tolerance between the fit of the recess of the bottom strip and the bottom profile occurs such that it cannot be guaranteed that the grinding element will be retained during operation of the cylinder drum, it is easy to replace the cheap bottom strip can be done.

Furthermore, it will be much cheaper to replace the bottom strip instead of repairing or replacing the cylinder drum.

The grinding elements will be connected to the bottom profile such that the grinding elements in relation to the rotational direction of the cylinder drum are placed before the brushes, thereby supporting the grinding elements, the position of which grinding elements is approximately vertically.

The brushes also prevent that the grinding elements bend/break and thereby are forced down towards the surface of the cylinder drum, thus loosing their grinding effect.

In order to apply different types of grinding elements in the same profile strip, it is important that the distance between the cross-sectional form of the bottom profile and the bottom strip is of a specific width ± an acceptable tolerance.

Since there are differences in relation to the thickness of the grinding elements, it will not be easy to replace the grinding elements.

For example, sand paper with grain 600 is thinner than sand paper with grain 60. This means that if the same profile strip is applied for both types of sand paper, a bottom profile with sand paper (grain 60) would not be able to be mounted in the bottom strip, while a bottom profile with sand paper (grain 600) would be to loose in the bottom strip.

In order to solve this problem, a grinding element, which along a side edge is designed with an edge zone without a grinding effect, is provided according to the present invention.

The grinding elements are typically constructed with a supporting canvas onto which the grinding particles are arranged. The supporting canvas typically has the same thickness regardless of which grinding particles are applied.

This entails that the edge zone has the same thickness on different grinding elements, and since it is the edge zone part of the grinding elements which is placed between the bottom profile and the bottom strip, it is not necessary that the distance between the cross-sectional form of the bottom profile and the bottom strip has different widths depending on the selected grinding element. Therefore, it will be possible to apply the same profile strip in connection with different grinding elements.

In a preferred embodiment of the present invention, the grinding elements are sand paper comprising a canvas onto which grains of sand are arranged, and where the edge zone is placed along a side edge of the sand paper and is designed without grains of sand.

The sand paper may either be provided with an edge zone without grains of sand, or the grains of sand may subsequently be removed mechanically, i.e. with a laser, a diamond cutter or the like.

The width of the edge zone measured from the side edge to the part of the sand paper which is provided with grains of sand depends on the height of the bottom profile measured from the bottom of the recess in the bottom strip to the surface of the cylinder drum, as the sand paper must be clamped between the bottom profile and the bottom strip. In order to mount the bottom profile in the bottom strip such that the bottom strip is retained during rotation of the cylinder drum, it is important that the width of the edge zone essentially corresponds to the height of the bottom profile such that the canvas of the sand paper which is provided without grains of sand may be clamped between the bottom profile and the bottom strip.

In an embodiment of the present invention, the grinding elements are firmly connected to a side edge of the bottom profile, i.e. by gluing, tacking or moulding which entails that the bottom profile including attached grinding elements and moulded brushes may be manufactured separately and subsequently mounted in the bottom strip.

The grinding elements will be glued onto the side edge of the profile strip which is at the front in relation to the rotational direction of the cylinder drum which entails that the grinding elements are supported by the brushes.

Alternatively, the grinding elements may be fasted with staples, nails or the like to the bottom strip.

In an embodiment according to the present invention, the bottom profile is designed with a cross-sectional form which is complementary to a cross-sectional form of a recess in the bottom strip which entails that the bottom profile is retained in the bottom strip, for example while the cylinder drum is rotating or the profile strip is placed on the part of the cylinder drum turning downwards while the cylinder drum is in non-operating position.

The bottom strip is designed such that it for example has an undercut recess or a U or C-profile or the like, which is pretensioned such that the bottom profile is retained in the bottom strip, and simultaneously easily may be replaced when the grinding elements and/or the brushes are worn out.

In order to apply the profile strip according to the present invention in different cylinder drums, the cross-sectional form of the bottom strip is complementary to a cross-sectional form of an undercut recess in the cylinder drum.

The profile strip can therefore easily be introduced into the undercut recess of the cylinder drum and simultaneously be retained while the cylinder drum is rotating.

The centrifugal force impacting on the profile strip while the cylinder drum rotates contributes to press the bottom strip outwards, whereby a clamp pressure occurs on the sides of the bottom strip, which clamp pressure contributes to retain the bottom profile.

Furthermore, it is not possible to loosen the grinding element from the profile strip as a radially, outwardly directed force (in relation to the cylinder drum) on the grinding element entails that a clamp pressure occurs on the sides of the bottom strip, whereby the bottom profile is clamped and the grinding element is further retained.

If the profile strip has to be moved from one cylinder drum to another or the cylinder drum has undercut recesses with different cross-sectional forms, the bottom profile may easily and quickly be placed in another bottom strip of which the cross-sectional form is complementary to the undercut recess of the cylinder drum.

In order to achieve a flexible profile strip which can be applied in cylinder drums with lineary as well as curved undercut recesses, the bottom strip and the bottom profile are designed of a plastics material whereby the profile strip easily and quickly may be mounted in the recess of the cylinder drum. The bottom strip is rigid enough to be pressed/pulled through the recess, but it is also flexible, which is an advantage if the recess changes direction in the surface of the cylinder drum.

DESCRIPTION OF FIGURES

The present invention is described in detail in the appended figures, where.

DETAILED DESCRIPTION OF THE INVENTION

Figure 1:
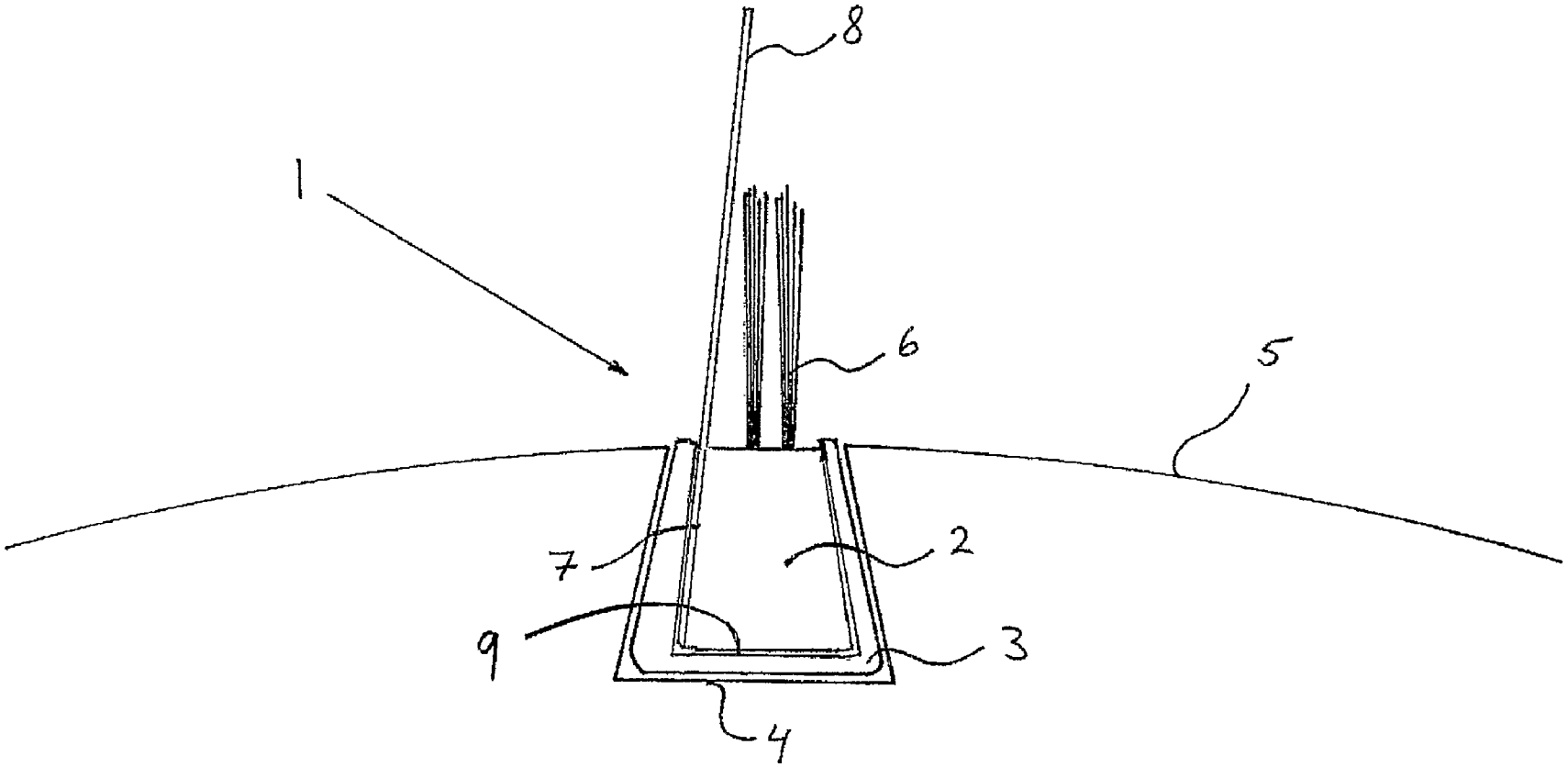
FIG. 1 shows a cross-section of a profile strip according to the present invention.

FIG. 1 shows a cross-section of a profile strip 1 comprising a bottom profile 2 and a bottom strip 3. The profile strip 1 is arranged in an undercut recess 4 in a cylinder drum 5. Bottom profile 2 is provided with moulded brushes 6, and onto a side edge 7 of the bottom profile 2 a grinding element is arranged in the form of sandpaper 8. The cross-sectional form of the bottom profile 2 is complementary to the recess 9 of the bottom strip 3, whereby the bottom profile 2 is retained while the cylinder drum 5 rotates. The cross-sectional form of the bottom strip 3 is complementary to the recess 4 of the cylinder drum 5, whereby the bottom strip 3 is retained while the cylinder drum 5 rotates.

Figure 2:
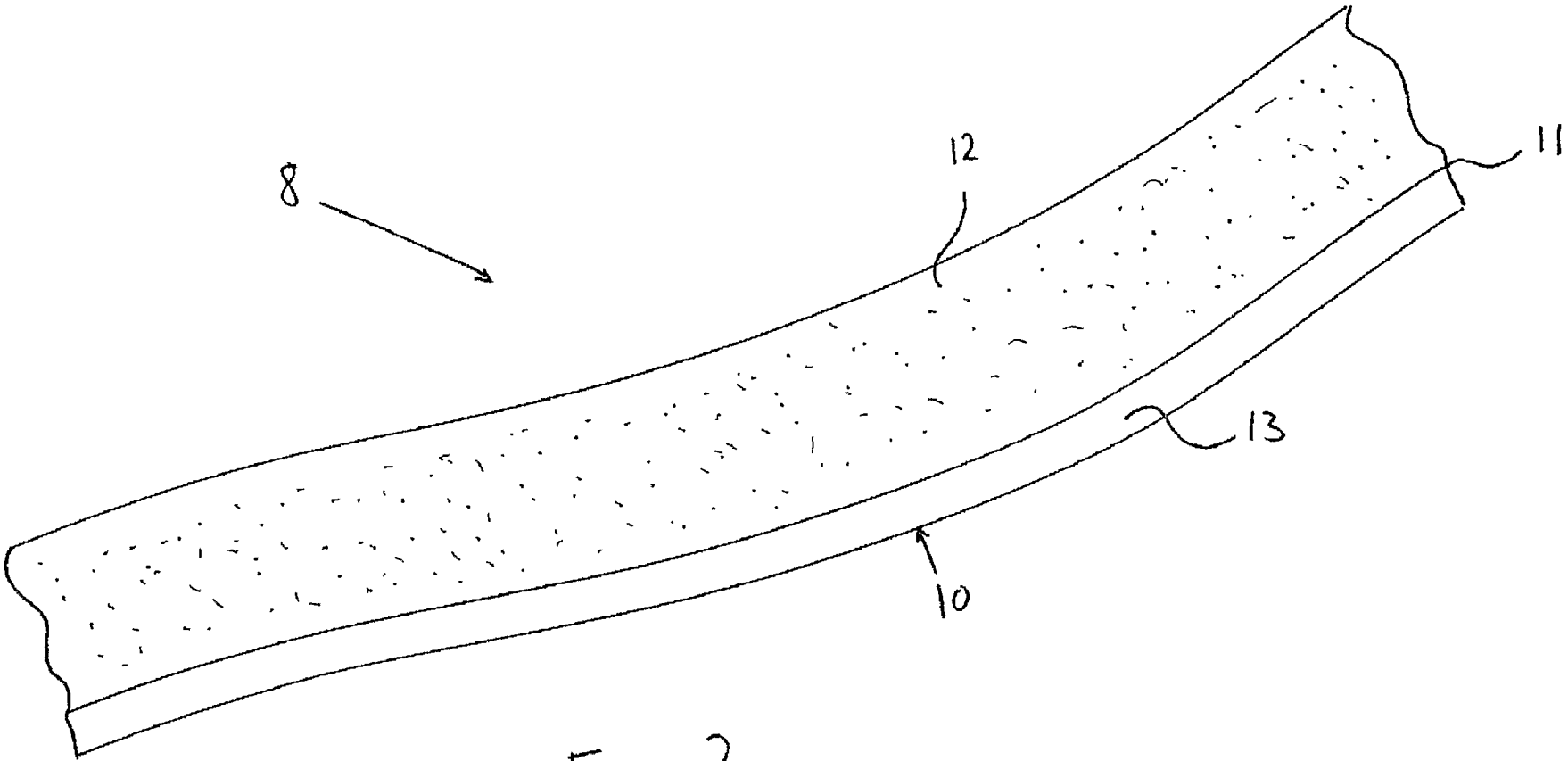
FIG. 2 shows a plan view of a sand paper.

FIG. 2 shows a piece of sandpaper 8 comprising a canvas 11 onto which grains of sand 12 are arranged and where along the length of a side edge 10 there is an edge zone 13 without grains of sand 12.

It should be noted that the cross-sectional forms of the bottom profile, the bottom strip and the recesses may be different than the ones shown in FIG. 1.

The invention claimed is:

1. Profile strip (1), preferably for a cylinder drum (5) and comprising a bottom profile (9) and a bottom strip (3) which is designed for replaceable retention of the bottom profile (2) which comprises a number of brushes (6) and at least one grinding elements (8) wherein the grinding element (8) along a side edge (10) is designed with an edge zone (13) without a grinding effect and that the edge zone (13) of the grinding element is designed for placing in the profile strip (1) between the bottom profile (2) and the bottom strip (3).

2. Profile strip (1) according to claim 1, wherein the at least one grinding elements (8) is sandpaper comprising a canvas (11) onto which grains of sand (12) are arranged and where the edge zone (13) is designed without grains of sand.

3. Profile strip (1) according to claim 1, wherein the at least one grinding elements (8) is connected to a side edge (7) of the bottom profile (2) which is designed with a cross-sectional form which is complementary to a cross-section of a recess in the bottom strip (3).

4. Profile strip (1) according to claim 3, wherein the at least one grinding elements (8) is glued to the side edge (7) of the bottom profile (2).

5. Profile strip (1) according to claim 4, wherein the cross-sectional form of the bottom strip (3) is complementary to a cross-sectional form of an undercut recess (4) in the cylinder drum (5).

6. Profile strip (1) according to claim 1, wherein the bottom strip (3) and the bottom profile (2) are formed of a plastics material.

7. A profile strip comprising a bottom profile and a bottom strip adapted for replaceably retaining the bottom profile, plural brushes on the bottom profile and at least one grinding element including at least one side edge comprising an edge zone without grinding effect, wherein the edge zone is disposable in the profile strip between the bottom profile and the bottom strip.

8. The profile strip of claim 7, wherein the at least one grinding element is a sandpaper element comprising a canvas with grains of sand disposed thereon.

9. The profile strip of claim 8, wherein the edge zone is without the grains of sand.

10. The profile strip of claim 7, further comprising a side edge on the bottom profile and a recess in the bottom strip.

11. The profile strip of claim 10, wherein the grinding element is connected to the side edge of the bottom profile.

12. The profile strip of claim 11, wherein a cross-section of the bottom profile is complementary to a cross-section of the recess in the bottom strip.

13. The profile strip of claim 10, wherein the grinding element is glued to the side edge of the bottom profile.

14. The profile strip of claim 13, wherein the profile strip is adapted for a cylinder drum.

15. The profile strip of claim 14, further comprising an undercut recess in the cylinder drum.

16. The profile strip of claim 15, wherein a cross-sectional form of the bottom strip is complementary to a cross-sectional form of the undercut recess in the cylinder drum.

17. The profile strip of claim 7, wherein the bottom strip and the bottom profile are formed of a plastics material.

* * * * *